US008894111B2

(12) United States Patent
Nakata et al.

(10) Patent No.: US 8,894,111 B2
(45) Date of Patent: Nov. 25, 2014

(54) SLIDE FASTENER CLOSING TOOL AND METHOD

(71) Applicant: YKK Corporation of America, Marietta, GA (US)

(72) Inventors: Yoshifumi Nakata, Marietta, GA (US); Tatsuya Deto, Macon, GA (US); Tomonari Yoshida, Novi, MI (US)

(73) Assignee: YKK Corporation of America, Marietta, GA (US)

( * ) Notice: Subject to any disclaimer, the term of this patent is extended or adjusted under 35 U.S.C. 154(b) by 0 days.

(21) Appl. No.: 14/037,537

(22) Filed: Sep. 26, 2013

(65) Prior Publication Data

US 2014/0167429 A1 Jun. 19, 2014

Related U.S. Application Data

(60) Provisional application No. 61/866,586, filed on Aug. 16, 2013.

(51) Int. Cl.

| | |
|---|---|
| ***A44B 19/00*** | (2006.01) |
| ***A44B 19/26*** | (2006.01) |
| ***A44B 19/28*** | (2006.01) |
| ***A47G 25/90*** | (2006.01) |

(52) U.S. Cl.

CPC ..... *A44B 19/285* (2013.01); *A47G 25/902* (2013.01)

USPC ..... 294/3.6; 24/429

(58) Field of Classification Search

CPC ..... A44B 16/00; A44B 19/10; A44B 19/18; A44B 19/26; A44B 19/30; A44B 6/00; B21F 45/18

USPC ..... 294/3.6, 15, 25, 26; 223/111; 24/426, 24/429, 415, 418, 419, 420, 430, 437; 70/68

See application file for complete search history.

(56) References Cited

U.S. PATENT DOCUMENTS

| | | | | |
|---|---|---|---|---|
| 1,598,183 | A * | 8/1926 | Whitney | 70/68 |
| 2,032,858 | A | 3/1936 | Schaper | |
| 2,811,763 | A | 11/1957 | Jordan | |
| 2,820,272 | A * | 1/1958 | Humphreys | 294/3.6 |
| 2,882,577 | A * | 4/1959 | Johnson | 294/3.6 |
| 3,704,491 | A | 12/1972 | Burgess | |
| 3,854,175 | A | 12/1974 | Yoshida | |
| 4,023,244 | A * | 5/1977 | Doguchi et al. | 24/429 |
| 4,081,882 | A * | 4/1978 | Toepelt et al. | 24/386 |

(Continued)

FOREIGN PATENT DOCUMENTS

| | | |
|---|---|---|
| DE | 1992278 | 8/1968 |
| JP | S50-031126 | 9/1975 |

(Continued)

*Primary Examiner* — Paul T Chin

(74) *Attorney, Agent, or Firm* — Kilpatrick Townsend & Stockton LLP

(57) ABSTRACT

Slide fastener closing tools and methods of using same. In one embodiment, the slide fastener closing tool is configured to help open or close a slide fastener on an article, such as but not limited to seat, while maintaining a predetermined alignment of the tool relative to the slide fastener. Maintaining the alignment between the tool and the slide fastener reduces the likelihood that the elements of the fastener tape are damaged during opening and closing of the slide fastener. In one embodiment, the tool includes a guide plate configured to help maintain such alignment.

21 Claims, 9 Drawing Sheets

(56) References Cited

U.S. PATENT DOCUMENTS

| | | | | |
|---|---|---|---|---|
| 5,249,832 | A * | 10/1993 | Leonardz | 294/3.6 |
| 5,293,671 | A | 3/1994 | Oda | |
| 5,603,542 | A | 2/1997 | Walker | |
| 5,975,386 | A | 11/1999 | Fernicola | |
| D435,328 | S | 12/2000 | Harris et al. | |
| 7,313,847 | B1 * | 1/2008 | Felix et al. | 24/426 |
| 8,307,518 | B2 * | 11/2012 | Cheung | 24/418 |
| 8,764,081 | B1 * | 7/2014 | Krieger | 294/3.6 |
| 2012/0167355 | A1 | 7/2012 | Takano et al. | |
| 2013/0014357 | A1 | 1/2013 | Smith | |

FOREIGN PATENT DOCUMENTS

| | | | |
|---|---|---|---|
| JP | S59-024707 | | 2/1984 |
| WO | 2011016123 | A1 | 2/2011 |
| WO | 2011109272 | A1 | 9/2011 |

* cited by examiner

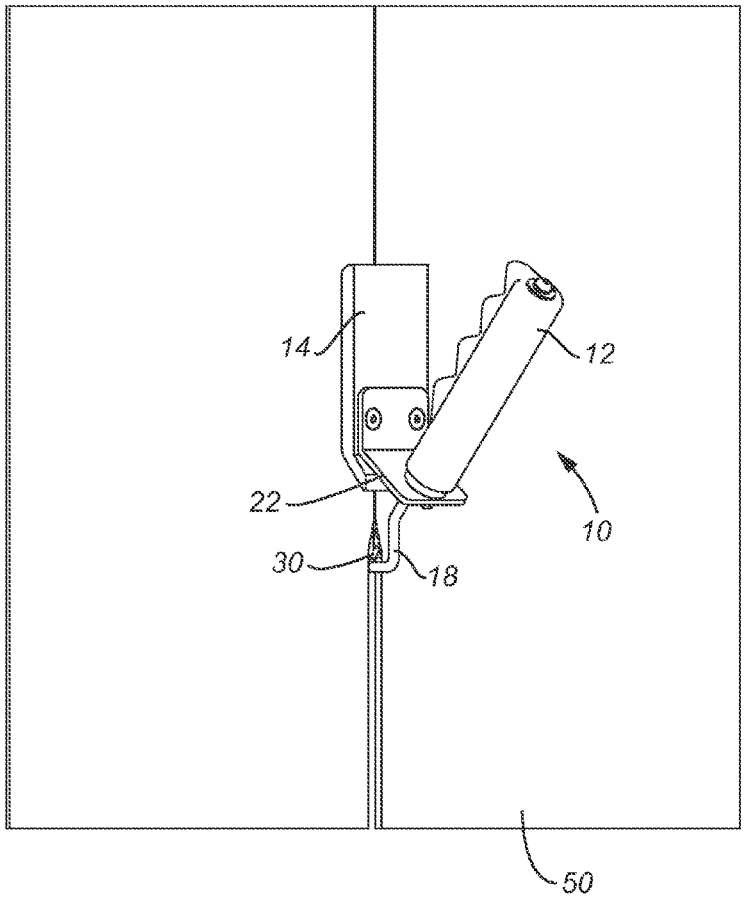
Fig. 7
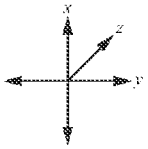

SLIDE FASTENER CLOSING TOOL AND METHOD

RELATED APPLICATION

This application claims the benefit of U.S. Provisional Application No. 61/866,586 filed Aug. 16, 2013 and titled "Zipper Closure Tool," the contents of which are incorporated herein by reference.

FIELD OF THE INVENTION

This invention relates to tools and methods for closing and opening slide fasteners.

BACKGROUND

A slide fastener typically includes a slider that cooperates with fastener elements located on opposite sides of a fastener tape to open and close the slide fastener. When the slider is moved in one direction (such as along the x-axis as shown in FIG. 7), a channel located between a top wing and a bottom wing of the slider meshes together rows of opposing elements of the fastener tape. When the slider is moved in the opposite direction, the channel separates the rows of opposing elements.

When the slide fastener is concealed and/or not easily accessible (as may be the case with slide fasteners used with vehicle seats, clothing, shoes, luggage and other applications), a tool may be used to assist with opening and closing the slide fastener. One non-limiting example of a concealed slide fastener is described in U.S. Publication No. 2012/0167355 filed Sep. 11, 2009 and titled "Fastener Stringer for Concealed Slide Fastener," the contents of which are incorporated herein by reference. In some cases, a concealed slide fastener includes a fastener tape connected to an interior surface of an article and a slider positioned within the interior of the article.

With most slide fasteners, it is important that the slider be properly aligned with the fastener elements during opening and closing of the slide fastener. If the slider laterally moves out of alignment with the slide fastener channel (i.e., if the slider moves along the y-axis of FIG. 7) and/or if the slider moves out of the plane of the slide fastener channel (i.e., if the slider moves along the z-axis of FIG. 7), it is possible that the elements of the tape will be damaged, potentially damaging the slide fastener.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Disclosed are tools and methods for opening and closing a slide fastener, including a slide fastener that is concealed and/or not easily accessible. The tool is configured to maintain alignment of the slider relative to the slide fastener elements during operation of the slider to open and close the slide fastener.

BRIEF DESCRIPTION OF THE DRAWINGS

Illustrative embodiments of the present invention are described in detail below with reference to the following drawing figures:

FIGS. 6-7 are views showing the tool of FIG. 1 in use with a slide fastener of an article.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Disclosed herein are tools to assist with opening and closing a slide fastener while maintaining proper alignment of the slider relative to the slide fastener elements. Such tools may be particularly useful when the slide fastener, including the slider, is concealed and/or not easily accessible. Concealed slide fasteners may be used in a variety of applications, including but not limited to clothing, shoes, luggage, and seat covers in automobiles, planes, trains, or other vehicles.

Figure 1:
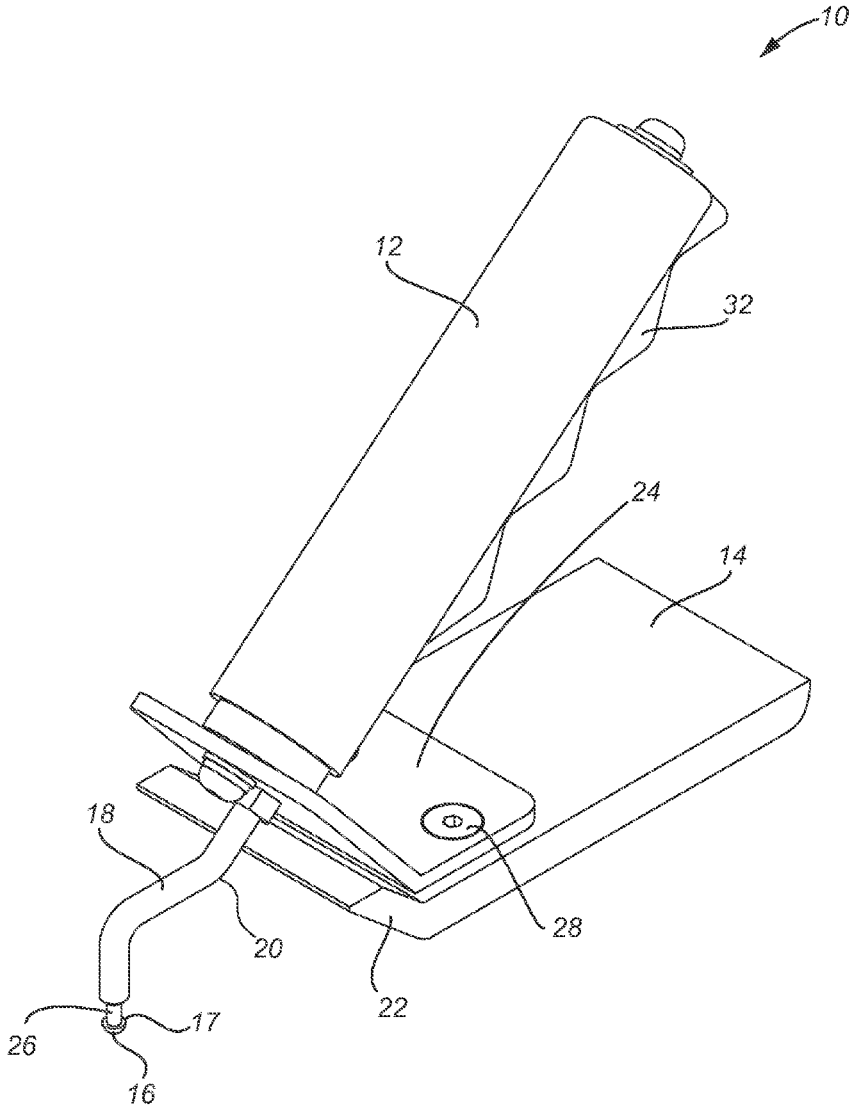
FIG. 1 is a side perspective view of a closing tool according to one embodiment.
Figure 2:
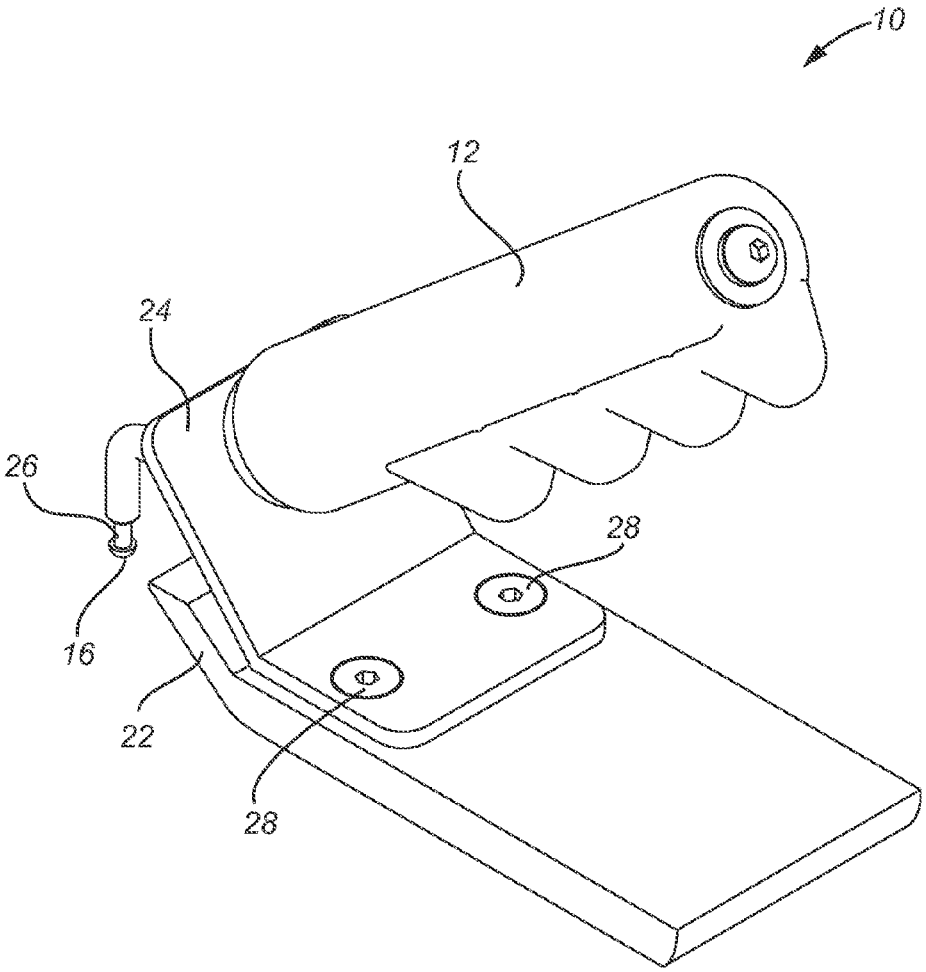
FIG. 2 is a rear perspective view of the tool of FIG. 1.

As shown in FIG. 1, tool 10 includes a handle 12, a guide plate 14, and an engagement tip 16 that projects from the distal end of a neck 18 and is configured to engage an aperture associated with a slider of a slide fastener. The engagement tip 16 may be generally hemispherical as illustrated and is dimensioned so its diameter is slightly smaller than the diameter of the aperture so that the tip can be received within the aperture. In some cases, the engagement tip 16 includes an edge 17 that helps maintain contact with the aperture during operation of the tool 10.

The diameter of the neck 18 may be dimensioned so that it is substantially equal to or larger than the diameter of the aperture to help prevent the insertion of the tool 10 into the article to which the slide fastener is attached beyond a predetermined depth. In some embodiments, spacer 26 separates the engagement tip 16 from the distal end of neck 18 to maintain a predetermined amount of separation between the neck 18 and the fastener tape. As illustrated, the amount of separation between neck 18 and engagement tip 16 is approximately 4 mm, although this distance may vary depending on the configuration and dimensions of the slide fastener and the slider with which the tool is used, as well as the material to which the slide fastener is attached and the manner of attachment used. In some embodiments, the diameter of spacer 26 is smaller than the diameter of the neck 18 and the diameter of the engagement tip 16 to allow the positioning of the slider relative to the engagement tip 16 to be adjusted along the spacer 26.

In the illustrated embodiment, guide plate 14 is attached to the handle 12 by an attachment mechanism 24. Attachment mechanism 24 includes a plurality of apertures through which fasteners 28 pass to secure the guide plate 14 and the handle 12 to the attachment mechanism 24. However, guide plate 14 may be coupled to the handle 12 in any suitable way. Alternatively, any combination of the handle, guide plate, and attachment mechanism may be integrated into a single component.

Guide plate 14 is configured to abut an exterior surface of the article to which slide fastener is attached to help maintain the alignment of the tool 10 (in particular, the engagement tip 16 and the handle 12) relative to the slide fastener. In particular, when the lower surface of the guide plate contacts an exterior surface of an article, the engagement tip 16 extends into the interior of the article and engages the aperture 19 associated with the slider 30 of the concealed slide fastener. Maintaining the alignment of the tool 10 relative to the slide fastener helps ensure that the slider moves properly (i.e., moves substantially straight along the x-axis of FIG. 7) relative to the fastener elements and helps prevent the tool from pulling the slider of the slide fastener toward the operator (i.e., pulled along the z-axis of FIG. 7) or laterally moving the slider out of alignment with the elements of the fastener tape (i.e., moved along the y-axis of FIG. 7). If the slider moves out of alignment with the fastener elements, the elements of the fastener tape are subjected to unwanted forces and are susceptible to damage. The size and shape of the guide plate 14 are selected to facilitate the stable movement of the tool 10. For example, the width of the tool 10 is selected so that the tool is stable laterally (y-axis) and the length of the tool is selected so that the tool is stable along the z-axis. In some cases, the tool is configured to help keep the spacer 26 and/or the distal end of the neck 18 generally perpendicular to the aperture 19 of the slider 30.

Neck 18 may include one or more bends 20 to provide clearance so tool 10 engages the aperture of the slider and moves the slider along the x-axis to open and close the slide fastener without obstruction. The one or more bends 20 may also help position the distal end of the neck 18 and/or the spacer 26 so they are generally perpendicular to the exterior surface of the article and so a longitudinal axis of the distal end of the neck 18 and/or spacer 26 is generally perpendicular to longitudinal axis of the aperture 19 of the slider 30, and to help ensure that the engagement tip 16 extends generally along the z-axis. In some embodiments, bends 20 are configured so the neck 18 does not contact the exterior surface of the article to which the slide fastener is attached when the engagement tip 16 is engaged with the aperture of the slider 30. Similarly, guide plate 14 may include a beveled edge 22 that helps move the tool 10 smoothly along an uneven surface, for instance if the article includes any pockets (such as map pockets) and/or decorative stitches. In some embodiments, guide plate 14 does not include a beveled edge.

Figure 3:
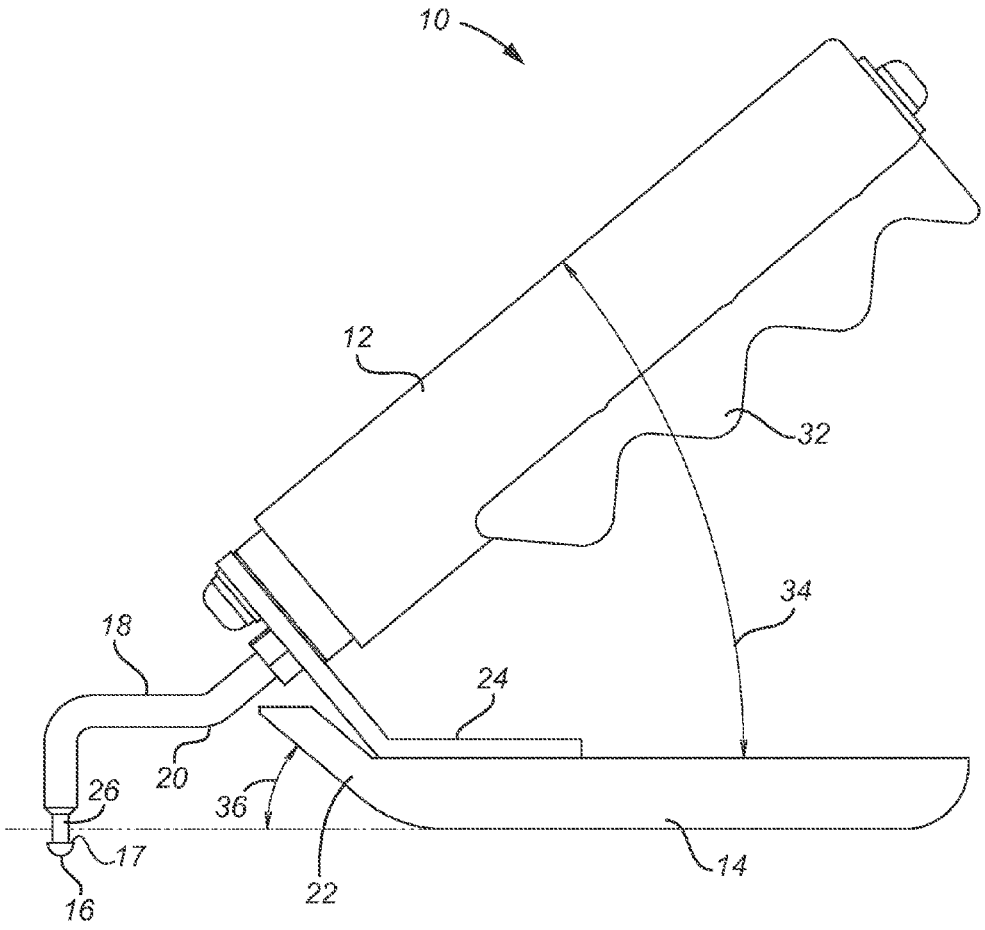
FIG. 3 is a side view of the tool of FIG. 1.
Figure 4:
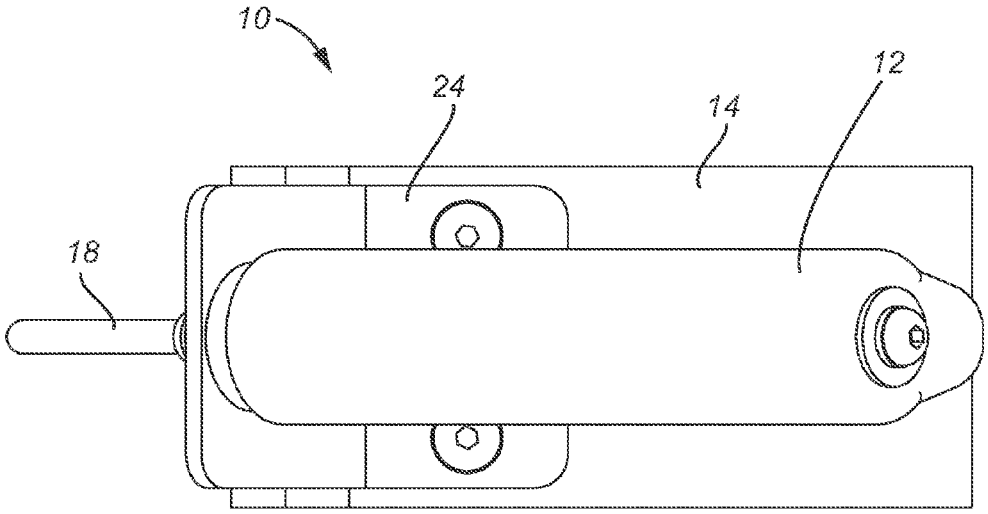
FIG. 4 is a top view of the tool of FIG. 1.
Figure 5:
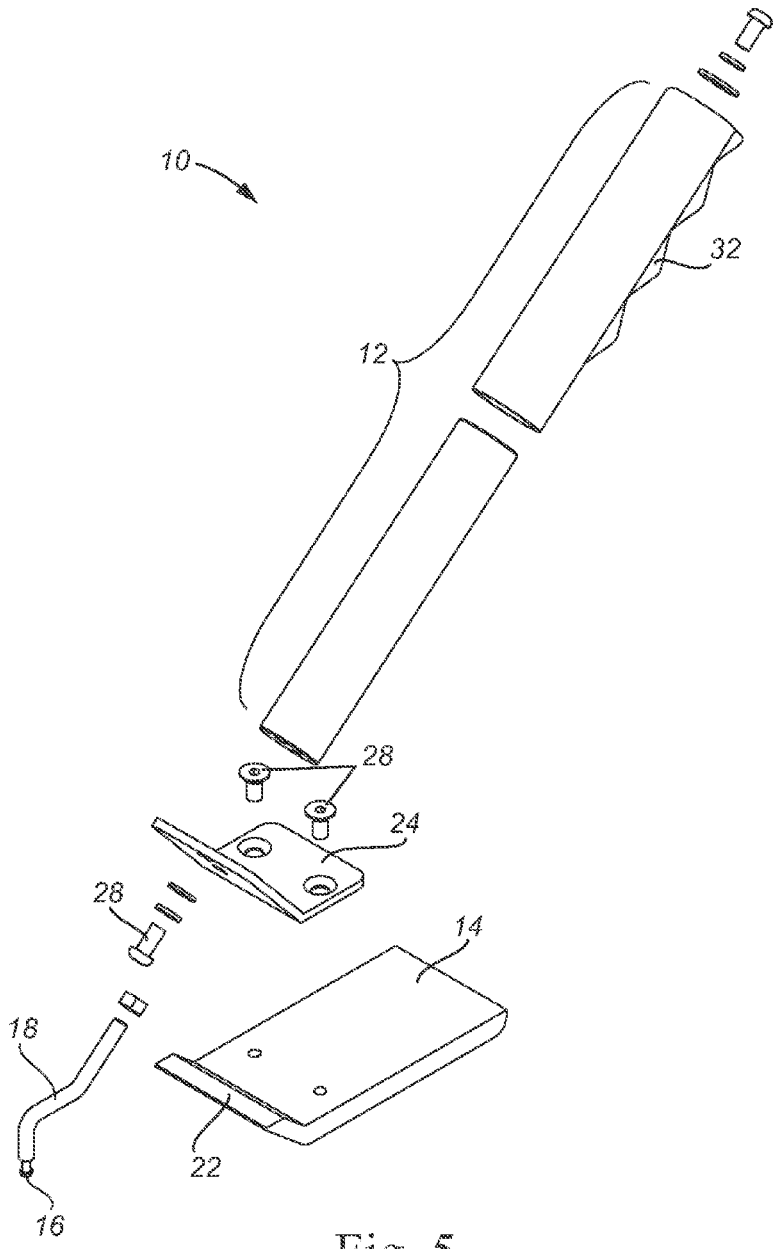
FIG. 5 is an exploded view of the tool of FIG. 1.
Figure 6:
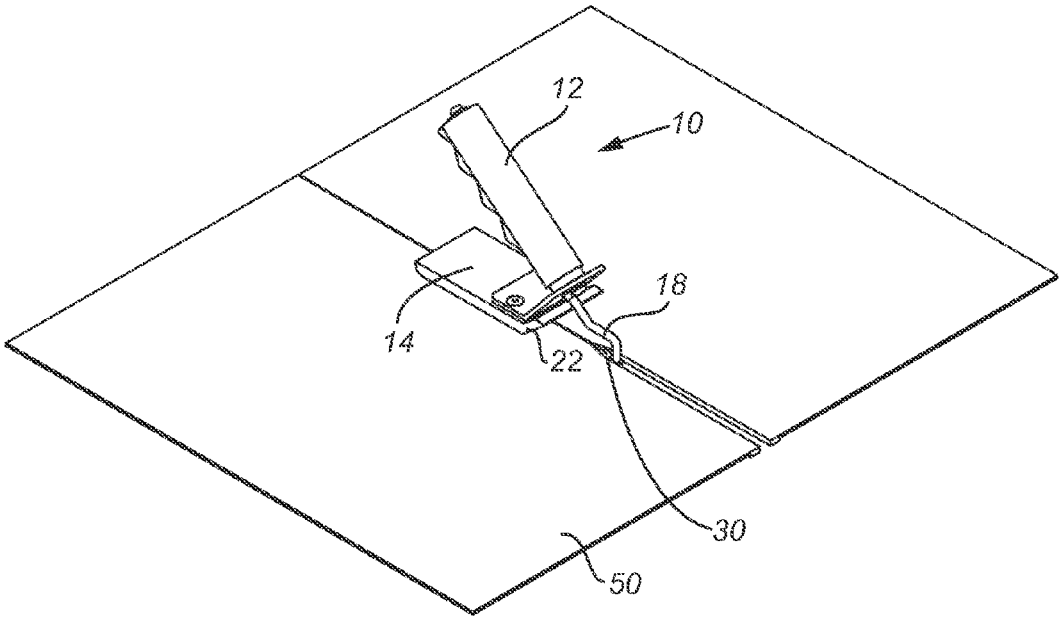
Figure 8:
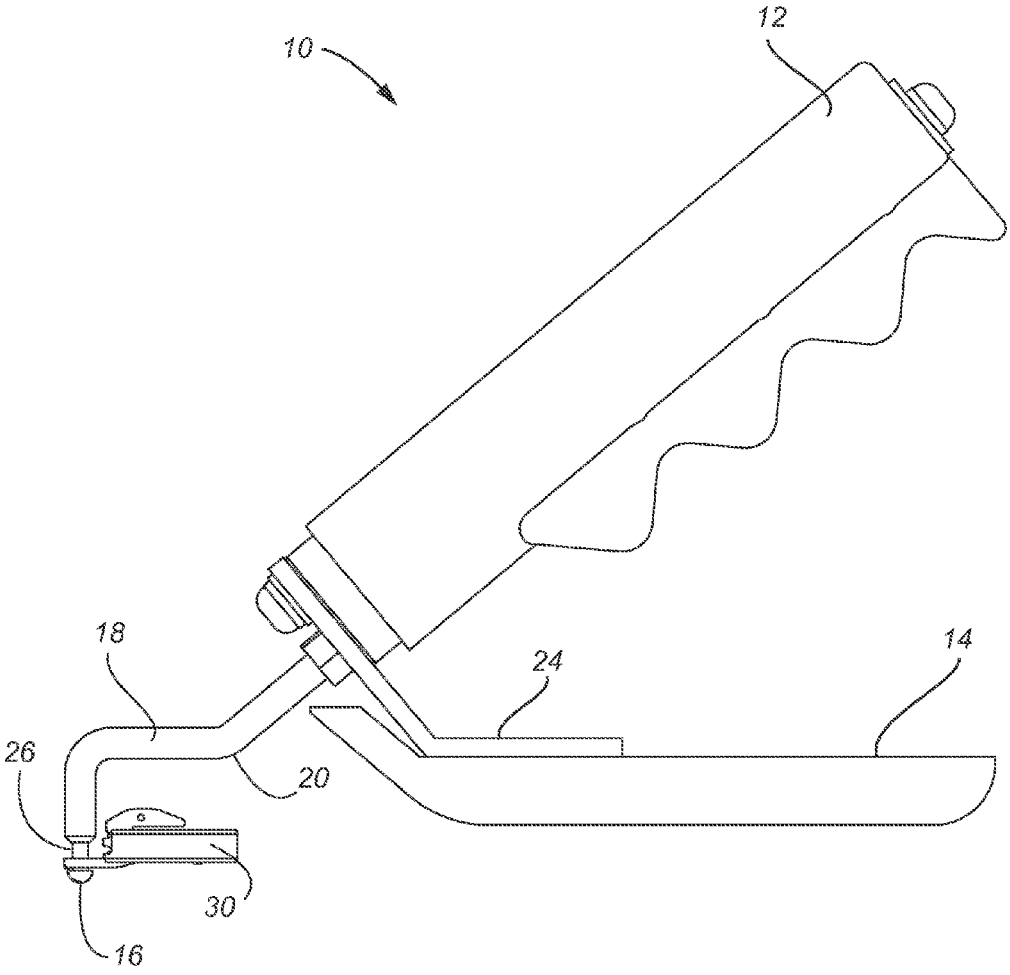
FIGS. 8-9 are views showing the tool of FIG. 1 in use with a slide fastener in isolation.
Figure 9:
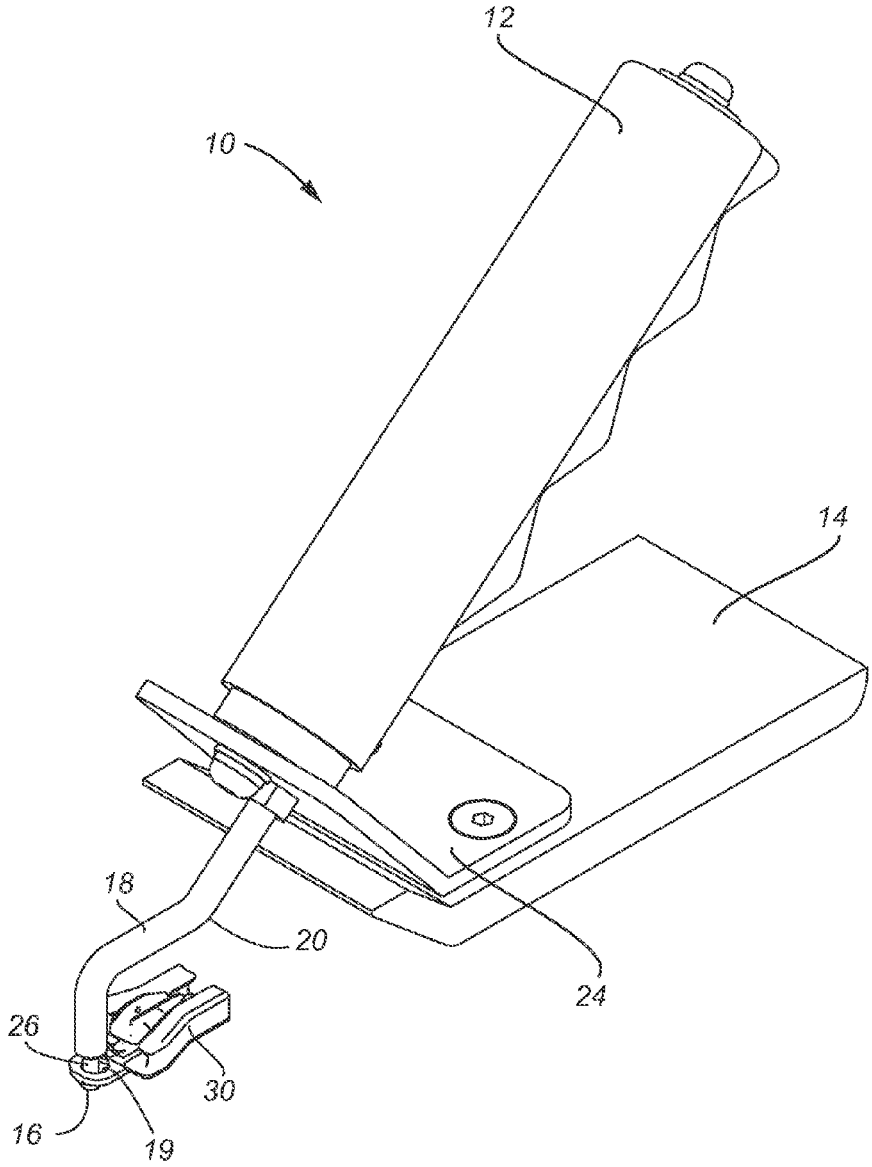

As shown in FIG. 3, a predetermined angle 34 between handle 12 and guide plate 14 may be fixed to maintain alignment of the tool 10 (in particular, the handle 12 and the engagement tip 16) relative to the slide fastener. In one non-limiting embodiment, angle 34 is less than approximately 45°, although other suitable angles may be used. Angle 34 may also be customized to provide ergonomic benefits to an operator of the tool and thus may vary. Moreover, as shown in the Figures, handle 12 may be configured to provide ergonomic benefits. For example, handle 12 may include an ergonomic grip 32. In addition, the length of the handle 12 and the length of the guide plate 14 are selected so that the handle is long enough to allow an operator to stably hold the handle, but the handle does not extend past the rear edge of the guide plate.

As shown in FIG. 3, angle 36 between bevel 22 and the base of guide plate 14 may be configured to help move the tool 10 smoothly along an uneven surface, for instance if the article includes any pockets (such as map pockets) and/or decorative stitches. As noted above, in some embodiments, guide plate 14 does not include a beveled edge. In one non-limiting embodiment, angle 36 is approximately 40°, although other suitable angles may be used depending on the configuration and dimensions of the slide fastener with which tool 10 is used.

In use, engagement tip 16 is inserted through an opening in the article and into aperture 19 associated with the slider 30 (see FIGS. 6-9). The tip 16 is then pushed into the interior of the seat 50 (or other article to which the slide fastener is attached) until the guide plate 14 encounters resistance. While the bottom surface of the guide plate 14 maintains contact with the seat (or other article), the tool 10 can be used to move the slider downward in the x-direction of FIG. 7 to close the slide fastener. To open the slide fastener, the tool 10 would be flipped (alternatively, the article could be flipped relative to the tool). Because the guide plate 14 stays in contact with the seat 50 as the tool moves to close (or open) the slide fastener, the guide plate 14 ensures that the handle 12 and the engagement tip 16 of the tool 10 remain in a predetermined alignment relative to the elements of the slide fastener. Maintaining the alignment helps minimize lateral and other undesirable forces on the elements that may damage the elements. Maintaining contact between the guide plate 14 and the article to which the slide fastener is attached also helps prevent the slider from being pulled along the z-axis toward the operator.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A slide fastener closing tool comprising:

a guide plate comprising an upper surface and a lower surface;

a handle coupled to the guide plate with an attachment mechanism, the attachment mechanism comprising:

a first portion and a second portion opposite the first portion;

a first end surface associated with the first portion and a second end surface associated with the second portion;

an upper surface extending between the first and second end surfaces; and a lower surface extending between the first and second end surfaces;

wherein the second portion of the attachment mechanism is coupled with the guide plate and the first portion of the attachment mechanism is coupled with the handle; and a neck that extends from at least one of the attachment mechanism, the guide plate and the handle, wherein a distal end of the neck comprises an engagement tip that extends beyond the lower surface of the guide plate, and wherein the distal end of the neck is generally perpendicular to a plane that includes the lower surface of the guide plate.

2. The slide fastener closing tool of claim 1, wherein the guide plate comprises a beveled edge that extends from a base of the guide plate at an angle between approximately 10 degrees and approximately 50 degrees.

3. The slide fastener closing tool of claim 1, wherein the neck includes one or more bends to provide clearance between the engagement tip and a tape of a slide fastener when the tool is engaged with an aperture of the slide fastener.

4. The slide fastener closing tool of claim 1, wherein the neck includes one or more bends that help ensure that a longitudinal axis of the distal end of the neck is generally perpendicular to a longitudinal axis of an aperture of a slide fastener when the tool is engaged with the aperture of the slide fastener.

5. The slide fastener closing tool of claim 1, wherein the handle comprises an ergonomic grip.

6. The slide fastener closing tool of claim 1, wherein the engagement tip has a generally hemispherical shape.

7. The slide fastener closing tool of claim 1, wherein the neck only extends from at least one of the attachment mechanism and the handle.

8. A tool for facilitating closing of a slide fastener, the tool comprising:

a handle, a neck, wherein an engagement tip extends from a distal end of the neck and is configured to engage an aperture of a slider of the slide fastener, a guide plate comprising an upper surface, a lower surface spaced apart from the upper surface, a front surface extending between the upper surface and the lower surface, a rear surface spaced apart from the front surface and extending between the upper surface and the lower surface, and a longitudinal axis generally parallel to a plane that includes the lower surface, wherein the lower surface is configured to abut an exterior surface of an article to which the slide fastener is attached to fix an angle between the handle and the slider when the engagement tip is engaged with the aperture and as the slider traverses along a longitudinal axis of the slide fastener, wherein the distal end of the neck extends forwardly beyond both the front and rear surfaces of the guide plate in a direction containing the longitudinal axis of the guide plate; and wherein the engagement tip extends below both the upper and lower surfaces of the guide plate in a direction generally perpendicular to the plane that includes the lower surface of the guide plate.

9. The tool of claim 8, wherein an angle between an upper surface of the guide plate and the handle is less than approximately 45 degrees.

10. The tool of claim 8, wherein the handle comprises an ergonomic grip.

11. The tool of claim 8, wherein the engagement tip has a generally hemispherical shape.

12. The tool of claim 8, wherein the engagement tip includes an edge that helps maintain contact between the engagement tip and the aperture during traversal of the tool along the longitudinal axis.

13. The tool of claim 8, wherein the neck includes one or more bends that help ensure that a longitudinal axis of the distal end of the neck is generally perpendicular to a longitudinal axis of the aperture of the slide fastener when the tool is engaged with the aperture of the slide fastener, wherein the one or more bends are such that the neck comprises:

a first portion extending from the handle, the first portion having a longitudinal axis that is generally parallel to a longitudinal axis of the handle; and a second portion having a longitudinal axis that is generally perpendicular to the plane containing the lower surface of the guide plate.

14. The tool of claim 13, wherein the one or more bends provides clearance between the engagement tip and a tape of the slide fastener when the tool is engaged with the aperture of the slide fastener.

15. The tool of claim 8, further comprising:

an attachment mechanism comprising a first portion coupled with the guide plate and a second portion opposite the first portion and coupled with the handle, and wherein the neck extends from the handle along a line that is parallel to a longitudinal axis of the handle and that extends through the handle.

16. The tool of claim 15, wherein the attachment mechanism comprises:

a first end surface associated with the first portion and a second end surface associated with the second portion;

an upper surface; and a lower surface;

wherein each of the upper and lower surfaces extends between the first and second end surfaces.

17. A method of using a tool to close a slide fastener comprising:

providing the tool, wherein the tool comprises a handle coupled to a guide plate at a predetermined angle and an engagement tip that projects from a distal end of a neck extending from the handle;

inserting the engagement tip of the tool into an interior of an article until the engagement tip contacts an aperture of a slider of the slide fastener;

placing a lower surface of the guide plate of the tool against an exterior of the article on which the slide fastener is attached; and sliding the guide plate while keeping the lower surface of the guide plate in contact with the exterior of the article to operate the slide fastener.

18. The method of claim 17, wherein providing the tool comprises providing a tool with a guide plate having a beveled edge.

19. The method of claim 17, wherein providing the tool comprises providing a tool with an engagement tip that is generally hemispherical.

20. The method of claim 17, wherein providing the tool comprises providing a tool with a neck with one or more bends.

21. The method of claim 17, wherein providing the tool comprises providing a tool comprising a handle coupled to a guide plate, wherein an angle between an upper surface of the guide plate and the handle is less than approximately 45 degrees.

* * * * *